United States Patent [19]

Hansberg

[11] 4,050,504

[45] Sept. 27, 1977

[54] CORE-BLOWING MACHINE FOR PREPARING MOULDS AND FOUNDRY CORES

[76] Inventor: Julius Hansberg, Via Bellinzona 31/2, Modena, Italy

[21] Appl. No.: 682,354

[22] Filed: Apr. 30, 1976

[30] Foreign Application Priority Data

Apr. 30, 1975 Italy ..... 22897/75

[51] Int. Cl.[2] ..... B22C 15/24

[52] U.S. Cl. ..... 164/201

[58] Field of Search ..... 160/200, 201, 202; 164/19, 201

[56] References Cited

U.S. PATENT DOCUMENTS

| | | | |
|---|---|---|---|
| 2,654,924 | 10/1953 | Wood et al. | 164/200 |
| 3,212,141 | 10/1965 | Hansberg | 164/201 X |
| 3,807,483 | 4/1974 | Buhler | 164/202 X |
| Re. 28,735 | 3/1976 | Lund et al. | 164/200 |

FOREIGN PATENT DOCUMENTS

| | | | |
|---|---|---|---|
| 920,087 | 3/1963 | United Kingdom | 164/202 |

*Primary Examiner*—Ronald J. Shore
*Attorney, Agent, or Firm*—Karl W. Flocks

[57] ABSTRACT

In a core-blowing machine, the improvement consisting in that the inner wall of the ramming frame has a plastics material coating, the latter having a protrusion in its top edge area. This protrusion abuts the sandslinger head. Wear of the ramming frame is drastically reduced and a better air venting of the flask is ensured.

9 Claims, 4 Drawing Figures

CORE-BLOWING MACHINE FOR PREPARING MOULDS AND FOUNDRY CORES

The invention relates to a core-blowing machine for preparing foundry moulds, matrices and the like in which the mass to be shaped, arranged in a forming mass container, is to be introduced by a compressed air blow in an enclosure through a sandslinger head - into the flask to be filled up, the top side of which can be pressed against a pressing frame arranged externally of the sandslinger head, said frame being displaceable relative to the sandslinger head slidably thereon during the subsequent pressing of the forming mass blown into the flask.

In machine of the kind referred to above, the forming sand or earth is pressed without any particular turbulence and admixture with air and shocks against the flask to be filled; the compressed air blow which is necessary to this purpose is produced by a shooting valve, which opens for a short time a chamber which contains air under pressure.

A core-blowing machine is known (German Pat. No. 1,209,703) in which a cylindrical sand container is surrounded by an annular chamber which contains air under pressure. At the bottom end of the sand container there is arranged a so-called sandslinger head with a horizontally positioned plate, of the grid type, through which the sand or earth is blown by a compressed-air blow into the flask to be filled.

In order that the sand blown in the flask may subsequently be further rammed, the known machine is equipped with a pressing frame, which is slidably arranged on the outer side of the sandslinger head and against which, during the throw or the shoot of the earth and subsequent pressing thereof, the top side of the flask to be filled is pressed. In a first instant of rime the flask is overfilled by a sand blow so that a sand monticule is formed, which emerges above the top side of the flask. After the sand blow, the filled up flask is lifted and urges the pressing frame upwards, which is displaceable in the vertical direction so that, concurrently, the overfilled flask is pressed against the plate of the sandslinger head, so that the jutting sand monticule is smoothed out. During a fresh depression of the flask with the compressed earth or sand the pressing frame, subsequently, arranged in a displaceable manner on the sandslinger head, is restored by its bottom position again.

The sand to be blown with a high pressure in the flask, during the filling stage, is not to be sprayed through the slot left between the sliding surfaces of the slandslinger head and the pressing frame.

A pressing frame laid in a sealtight manner on the outer side of the sandslinger head with so tiny a clearance that the sand particles in dust form contained in the forming sand are not allowed to pass therethrough, tends, however, to become locked and cannot be depressed rapidly enough to its depressed position after the filling stage. In the conventional core-blowing machine it has thus been suggested to arrange between the sliding surfaces of the sandslinger head and the pressing frame a comparatively wide supporting clearance and to close this gap in a sealtight manner by means of a compressed air gasket. The pressing frame is fitted with a plurality of opening in the shape of slots for the ejection of air.

In the case of a relative displacement between the pressing frame and the sandslinger head, the result is that the deaeration openings arranged on the pressing frame are closed with an increasing displacement. A displacement between the pressing frame and the sandslinger head takes place, firstly, during the blowing, since in this case the pressing frame is laid with pressure on the flask to be filled.

A further displacement takes place, during pressing. With an increasing displacement between the pressing frame and the sandslinger head there is the drawback that the cross-sectional area available for the ejection of air diminishes.

The conventional pressing frame closed in a sealtight manner with compressed air, moreover, does not slide easily. The pressing frame of a core-blowing machine should, however, be easily movable to enable the machine to attain high blow frequencies for the sand. The compressed air seal, in addition, is prone to a considerable wear on account of the lifting and depressing motions of the pressing frame in this conventional core-blowing machine.

The invention aims at preventing these defects and providing a core-blowing machine with a pressing frame which is reliable in operation and in which, in spite of the displacement between the pressing frame and the sandslinger head, the entire surface existing in the air-ejection ports is active in the pressing frame, the pressing frame being easily slidable but close in a sealtight manner and said frame, in spite of its displaceability in the vertical direction, being subjected to the minimum possible wear.

This object is achieved according to the invention in a core-blowing machine for preparing matrices and foundry moulds and the like, in which the forming mass arranged in a forming mass container is to be introduced by a compressed air blow through a sandslinger head in the flask to be filled, the top side of which can be pressed against a pressing frame arranged externally to the sandslinger head, said frame being slidably displaceable relative to the sandslinger head and on the same head during the pressing of the forming mass enclosed in the flask and has air-ejection openings, wherein the inner wall of the pressing frame, in the area of its top edge, has a projection lying on the outer surface of the sandslinger head. By this suggestion, the result is that the air-ejection ports existing in the pressing frame are always open during the displacement between the pressing frame and the sandslinger head.

Heretofore, the de-aeration openings of the pressing frame has the only task of serving to remove air during the closure. It has been found, however, that it is also important to provide, during pressing, a de-aeration which is sufficient to have the air left in the sand mould to flow out during pressing. The approach tendered by the invention thus ensures that the cross-sectional area of ejection of the air-escape nozzles is fully retained during the blow and also during the subsequent compression ramming, irrespective of the local position, that is, of the relative displacement between the sandslinger head and the pressing frame.

In an embodiment of this invention it is suggested that the inner wall of the pressing frame is coated by a wall constituted by a plastics material, said latter wall having in the area of its top edge a projection lying on the sandslinger head. This approach should be intended in the sense that the projection, lying on the other surface of the sandslinger head, is composed by a plastics material. The plastics material projection of the pressing frame has a fair slip characteristic and a satisfactory yieldability. It is preferably composed, like the entire coating, since the projection and the coating are an entity, by polyethylene, polyurethane or nylon.

In a further embodiment of the invention it is suggested that on the outer wall of the coating which confronts the inner wall of the pressing frame, a metal strip is embedded, which is equipped with tapped holes and, moreover, that the coating is connected with the pressing frame by screws with the insertion of spreaders therebetween. By this expedient, the result is a particularly simple fastening of the coating to the inner wall of the pressing frame, said fastening concurrently ensuring an unhindered air ejection.

In yet another embodiment of the invention it is suggested that the coating is equipped with a plurality of air ejecting openings in the form of slots and in the pressing frame oversized openings for air are provided, preferably in the form of holes. In still another embodiment of the invention, the pressing frame is externally surrounded by a chamber which exhibits downwardly directed air-ejection ports.

In yet another embodiment of the invention, it is suggested that the sandslinger head exhibits, in correspondence with its external periphery, a hardened metal ledger on which rests the projection of the ledge formed by a plastics material as an inner coating of the pressing frame. To provide the sliding surface between the sandslinger head and the pressing frame of a hardened metal on the one side and a plastics material on the other side, affords the advantage that forming material passing between the hardened ledger and the plastics material frame in the form of a tiny granules does not originate any wear, but this forming sand lightly penetrates the surface of the plastics material and finally migrates along the surface thereof towards the exterior. By so doing the possibility is still afforded of a convenient vertical displacement of the pressing frame. Field tests have shown that, when the core-blowing machine according to the invention is daily used, the plastics material ledger can be used for more than one year. Only the hardened ledger is to be replaced after six months approximately.

The core-blowing machine according to the invention not only affords the advantage of being subjected to a negligible wear, but also the additional benefit that also non-parallelepipedal flask can be used, since a slight incline of the plastics material frame is not detrimental because the latter is yieldable enough. In the conventional core-blowing machines with a pressing frame flask at an incline could not be used since the pressing frame would become restrained and high losses of sand were experienced between the pressing frame and the top side of the flask to be filled.

In a further embodiment of this invention it is suggested that in a pressing frame is sprung by pneumatic rams, more particularly compressed air rams, guiding pins are fastened to the sandslinger head, the pressing frame being also affixed on said pins and slidably guided. By this additional guide of the fastening, it is obtained that the ramming frame is better guided on the sandslinger head and the wear of the parts slidable relative to one another is further diminished.

The invention will be better explained in the following with reference to an embodiment thereof as illustrated in the accompanying drawings.

Figure 1:
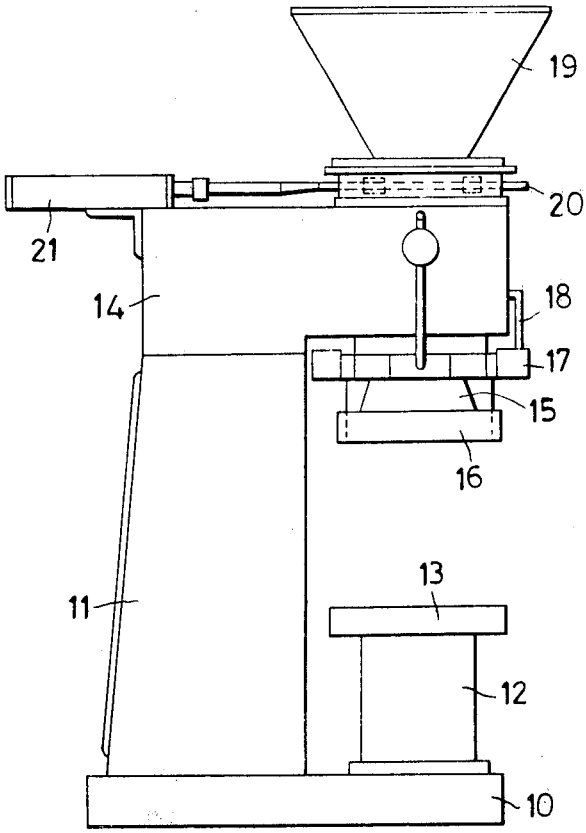
FIG. 1 shows a core-blowing machine in side elevational view.

FIG. 1 shows by way of example for an overall understanding, a core-blowing machine, which is equipped for the forming and the blowing with ramming of the formed mass as introduced by blowing. On a baseplate 10 there is arranged a framing 11 of the machine and a lifting ram 12. The lifting ram 12 is intended to lift and to depress again the table 13 of the machine on which the flask to be filled (not shown) is laid. In the head 14 of the machine frame are arranged the compressed-air-containing chamber which gives rise to the blow effect, and the container for sand or earth of the machine. At the bottom end of the sand container on the head 14 of the frame there is provided a core-blowing head 15, which exhibits on its outer periphery a pressing frame 16 which, by cylinders with piston, 17, preferably in the form of compressed-air rams, can be locked and released again as to its vertical motion. The cylinders and pistons 17 are controlled by a feed 18 by a machine pneumatic control automatic mechanism which is arranged in the head 14 of the framing. Above the head of the frame there is a funnel-shaped tank 19, from which sand, or another forming mass is conveyed to the sand container arranged on the head 14 of the machine frame through a loading slider 20. The loading slider 20 is actuated by means of a compressed-air ram 21, as applied to the machine frame.

Figure 2:
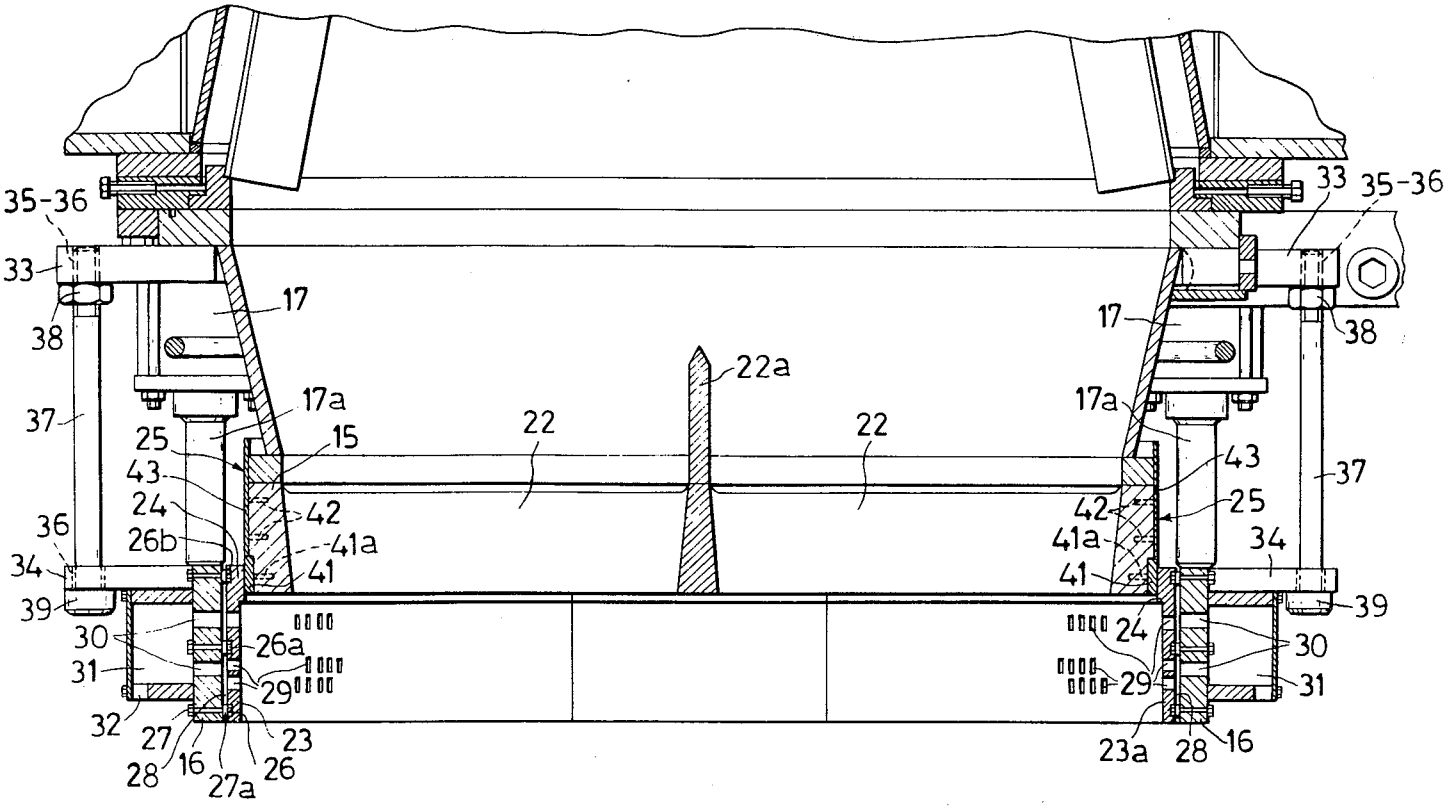
FIG. 2 is a vertical cross-sectional view on an enlarged scale of the sandslinger head of the machine shown in FIG. 1.
Figure 3:
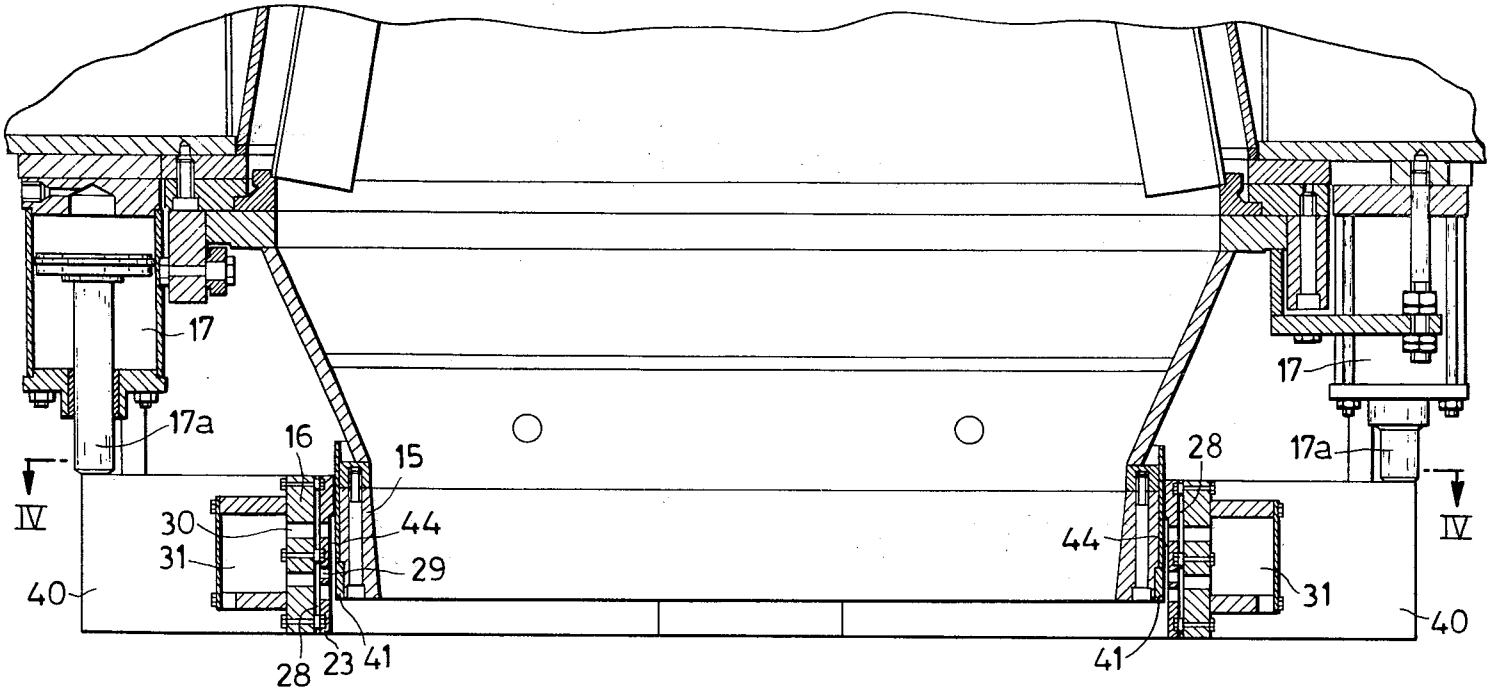
FIG. 3 shows a view taken by having FIG. 2 rotated through 90 degrees.
Figure 4:
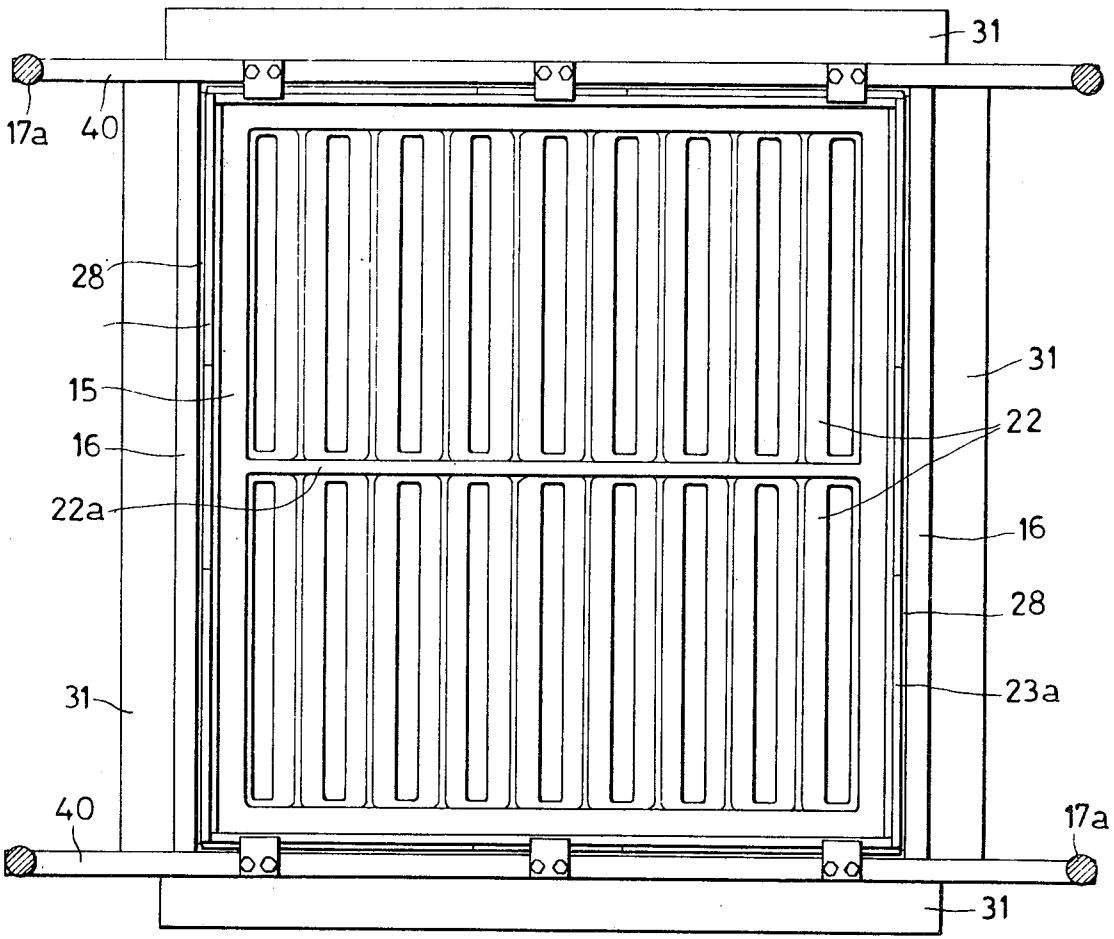
FIG. 4 shows a cross-sectional view taken through the sandslinger head of FIG. 3 along the line IV—IV.

In FIGS. 2, 3 and 4 it can be seen that the sandblowing head has a plate, arranged horizontally and having the shape of a grid, with the grid components 22 and 22*a*, between which the forming material is blown under pressure into the flask. The pressing frame 16 exhibits an inner wall 23 formed by plates. These plates are formed by a plastics material, having a high resistance and displaying good slipping properties, more particularly polyethylene, polyurethan or nylon. In the surroundings of the top edge of the plastics material plate 23 a projection 24 is provided, which rests on and contacts the outer hood surface 25 of the sand-blowing head 15. The ledgers 23, 23*a*, exhibit at their sides confronting the supporting frame of the ramming frame 16, metal rails, longitudinally embedded, 26, 26*a*, 26*b*, fitted with tapped holes. The ledgers 23 are at a distance relative to the inner surfaces of the pressing frame 16. Such a distance is provided by the fact that between the plates 23, fastened by screws 27, and the pressing frame 16 washers 27*a* are provided. By so doing, between the plates 23 or 23*a*, and the frame 16 there is a sufficiently sized slot 28 intended to remove air. The plates 23 are equipped with air vents 29 in the form of slots, which are best seen in FIG. 2.

FIG. 2 shows the pressing frame 16 in its depressed position. It can be seen that the air during blowing reaches the openings 29 through the slots 28 and the bores 30, existing in the frame 16, reach a chamber 31, surrounding the pressing frame, said chamber having outlet ports 32 pointing downward. The annular chamber surrounding the pressing frame has, inter alia, the purposes of ensuring an acoustic dampening and of braking the airflow in the interior of the chamber 31.

From the sandslinger head jut flanges 33 and from the pressing frame, flanges 34. The flanges are fitted with holes 35 and 36. The hole 35 of the flange existing on the sandslinger head (four flanges in total are provided) is equipped with a screwthread 36. In the holes 33 and 34 there is inserted a screw with a head 37 having a long stem, the screwthread formed at the front end of the headed screw 37 being screwed in the screwthread 36 of the flange 33. Safety is afforded by a nut 38. In FIG. 2 there can be seen that the flange 34 on the head 39 of the screw 37 is supported at its base and that the stem of the screw 37 serves as a sliding guide for the pressing frame 16 through the flange 34.

In FIG. 3 there can be seen a cylinder and piston arrangement 17, the piston stem 17*a* being borne by a ledger 40 of the frame 16, to obtain the above outlined effect according to which, during the blow, the piston stem takes its lower position and the ramming frame, correspondingly an similarly, its lower position also. At the blow, the position of the piston is latched in its lower posture by means of pressurizing. For the ramming compression the pressure in the chamber 17 of the cylinder is decreased so that the table 13 with its further lifting involves the ramming of the forming material which has been blown into the flask.

In FIG. 2 it can be seen that the surface of the outer casing of the sandslinger head is equipped with a ledger 41, circular and hardened, preferably made of steel, which ledger is releasably applied by screws 41*a.* Towards the top side, a ledger 43 is extended, which is thinner, otherwise fastened by screws 42 and advantageously formed by hardened steel.

FIG. 3 shows that in the case of the ramming frame, lifted relative to the sandslinger head, between the surface of the outer casing of the sandslinger head and the internal surface of the plastics material coating 23 there is a slot 44 that, connected with the slot 28 between the plastics material coating 23 and the inner surface of the supporting structure for the ramming frame 16, two slots are provided. FIG. 3 shows, in addition, that the slotlike openings in the plastics material coating are open for each position of the ramming frame relative to the sandslinger head so that, even during a ramming step, a sufficient air vent is provided.

I claim:

1. In a core-blowing machine for making moulds, foundry cores and the like, said machine comprising a forming mass container, a sandslinger head arranged below said container, a ramming frame slidably arranged externally to a lower end of said sandslinger head so as to be vertically displaceable from a lowered position in which said ramming frame projects downwardly from said sandslinger head to a raised position in which said ramming frame is retracted around said sandslinger head, and a flask supporting table arranged below said sandslinger head and provided with means for vertically displacing said flask supporting table towards said head, the improvement comprising said ramming frame having an inner wall formed by an inwardly projecting upper portion in slidable contact with the outer surface of the lower end of said sandslinger head and a recessed lower portion having air venting holes and spaced from said outer surface so that at least one air venting passage communicating with said holes is defined between said outer surfaces of said sandslinger head and said inner wall of said ramming frame when said ramming frame is in its raised position.

2. A device according to claim 1 further characterized in that said inner wall of said ramming frame includes a wall of a plastic material having in the area of its top edge said projection resting on said sandslinger head.

3. A device according to claim 2 further characterized in that said wall of plastic material is spaced from said inner wall of said ramming frame for improved air venting.

4. A device according to claim 3 further characterized in that said plastic wall has a plurality of openings in the form of slots for air escape.

5. A device according to claim 2 further characterized in that a strip formed of a metal is embedded in the outer surface of said plastic wall on the side towards the inner wall of said ramming frame and said strip is fitted with tapped holes, and screws connect said plastic wall and said ramming frame with spreaders inserted therebetween.

6. A device according to claim 2 further characterized in that said sandslinger head has at its outer periphery a hardened metallic ledger on which rests said projection.

7. A device according to claim 1 further characterized in that said ramming frame is externally surrounded by a chamber having openings for air venting directed downwardly.

8. A device according to claim 1 further characterized in that guide pins are affixed on said sandslinger head and said ramming frame is guided on said guide pins.

9. A device according to claim 1 further characterized in that flanges are affixed pairwise on said sandslinger head and on said ramming frame having holes therein which are aligned with each other, said holes in said flanges of said sandslinger head having a screwthread in the interior, and long screws having a head and a short screw-threaded shank inserted from below into said holes of said flanges with the screw-thread of said long screw screwed into said screw-thread of the tapped hole of said sandslinger head, and the stem of said screw serving as a guide for said flange on said ramming frame.

* * * * *